US006581507B2

(12) United States Patent
Mizutani et al.

(10) Patent No.: US 6,581,507 B2
(45) Date of Patent: Jun. 24, 2003

(54) SINGLE-HEADED PISTON TYPE SWASH PLATE COMPRESSOR

(75) Inventors: Hideki Mizutani, Kariya (JP); Manabu Sugiura, Kariya (JP); Kiyohiro Yamada, Kariya (JP); Masahiro Kawaguchi, Kariya (JP); Takayuki Kato, Kariya (JP); Takahiro Sugioka, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/897,171

(22) Filed: Jul. 2, 2001

(65) Prior Publication Data

US 2002/0020286 A1 Feb. 21, 2002

(30) Foreign Application Priority Data

Jul. 14, 2000 (JP) ..... 2000-214231

(51) Int. Cl.[7] ..... F01B 3/02

(52) U.S. Cl. ..... 92/71; 92/153

(58) Field of Search ..... 92/71, 153

(56) References Cited

U.S. PATENT DOCUMENTS

| | | | | | |
|---|---|---|---|---|---|
| 4,244,679 | A | * | 1/1981 | Nakayama et al. | 92/71 |
| 4,617,856 | A | | 10/1986 | Miller et al. | 92/71 |
| 5,875,702 | A | * | 3/1999 | Kawagoe et al. | 92/71 |
| 5,941,161 | A | * | 8/1999 | Kimura et al. | 92/71 |
| 5,974,946 | A | * | 11/1999 | Kanou et al. | 92/71 |

FOREIGN PATENT DOCUMENTS

| | | |
|---|---|---|
| JP | 57-42180 | 3/1982 |
| JP | 06-40385 | 5/1994 |
| JP | 10-068380 | 3/1998 |

* cited by examiner

*Primary Examiner*—F. Daniel Lopez
(74) *Attorney, Agent, or Firm*—Woodcock Washburn LLP

(57) ABSTRACT

A single-headed piston type swash plate compressor able to prevent wear of a coating when using a swash plate having a coating on a swash plate substrate to improve the slidability and in turn able to exhibit greater durability, wherein the swash plate is comprised of a swash plate substrate made of a ferrous material and a coating formed on at least one compression chamber side for improving the slidability with the ferrous material and wherein at least one shoe is comprised of a shoe substrate made of an aluminum-based material having a specific gravity smaller than that of the ferrous metal and coatings formed on the surfaces of the shoe substrate for improving the slidability.

8 Claims, 5 Drawing Sheets

SINGLE-HEADED PISTON TYPE SWASH PLATE COMPRESSOR

BACKGROUND OF THE INVENTION

1. Field of the Invention

The present invention relates to a single-headed piston type swash plate compressor used for a vehicle air-conditioning system etc.

2. Description of the Related Art

A refrigeration circuit used in a vehicle air-conditioning system includes a compressor for compressing a refrigerant gas. This compressor comes in various forms such as variable displacement types and fixed displacement types. More specifically, fixed displacement type compressors include not only single-headed piston type swash plate types, but also double-headed piston type swash plate compressors. Variable displacement type compressors also include not only single-headed piston type swash plate compressors, but also double-headed piston type swash plate compressors.

Among these compressors, a general single-headed piston type swash plate compressor of the fixed displacement type or variable displacement type defines and forms inside its housing cylinder bores, a crank chamber, a compression chamber, a suction chamber, and a discharge chamber. Each cylinder bore accommodates a single-headed piston so that it may reciprocate. Further, a drive shaft supported rotatably by the housing is driven by an engine or another external drive source. The swash plate is supported to be able to synchronously rotate with respect to the drive shaft. A pairs of shoes is accommodated in a pair of shoe seats provided at an engagement portion in the piston, to drive the pistons and a shoe is provided at each of the front and rear of the swash plate.

Here, since each piston is a single-headed piston having a head at only one of the front and rear of the swash plate, the compressor is a single-headed piston type swash plate compressor. Further, if the swash plate is provided at a certain inclination angle with respect to the drive shaft, the compressor is a fixed displacement single-headed piston type swash plate compressor. If the swash plate is provided to be variable in the inclination angle with respect to the drive shaft and the pressure in the crank chamber can be adjusted by a control valve to change the inclination angle and adjust the discharge capacity, it is a variable displacement single-headed piston type swash plate compressor.

In this single-headed piston type swash plate compressor, if the drive shaft is driven by an external drive source, the swash plate synchronously rotates, so the pistons reciprocate in the cylinder bores. Due to this, each cylinder bore forms a compression chamber with the head of the piston, so when the piston is in the suction stroke, low pressure refrigerant gas is sucked into the compression chamber from the suction chamber connected to an evaporator of the refrigeration circuit. When the piston is in the compression stroke, high pressure refrigerant gas is discharged to the discharge chamber from the compression chamber. This discharge chamber is connected to a condenser of the refrigeration circuit. The refrigeration circuit is used as a vehicle air-conditioning system for air-conditioning a vehicle. During this time, in the swash plate compressor, the slidability of the sliding portions between the swash plate and the shoes is ensured by a mist-like lubrication oil contained in the refrigerant gas.

Japanese Unexamined Patent Publication (Kokai) No. 10-68380 discloses a variable capacity type single-headed piston type swash plate compressor having pistons formed by an aluminum-based material and having a swash plate formed by a ferrous material.

In this variable capacity type single-headed piston type swash plate compressor, since the material of the swash plate is made larger in specific gravity than that of the pistons, the centrifugal force of the swash plate acting in the direction reducing the inclination angle becomes larger. Therefore, in this variable capacity type single-headed piston type swash plate compressor, it is possible to prevent a decline in the high speed controllability due to the inertia of the pistons acting in a direction increasing the inclination angle.

In the above swash plate compressors of the above related art, however, whether of the fixed displacement type or the variable displacement type, due to the specific gravity of the shoes, the swash plate became easily worn under severe conditions and therefore the durability was not necessarily sufficient. In particular, when using a swash plate comprised of a swash plate substrate made of a ferrous metal and a coating of a nickel-boron plating etc. for improving the slidability formed on at least the piston side, that is, the rear surface, of the swash plate substrate, the coating easily becomes worn under severe conditions due to the specific gravity of the shoes and therefore the durability is not necessarily sufficient.

That is, in a single-headed piston type swash plate compressor, as shown in FIG. 7, the pair of shoes 92*a*, 92*b* slidability in the circumferential direction with respect to the swash plate 91. The shoe 92*b* provided at the rear side (right side FIG. 7) among the shoes 92*a* and 92*b* is pressed against the swash plate 91 by a load in accordance with the rotational angle. At this time, a differential pressure based on the difference between the pressure inside the compression chamber and the pressure inside the crank chamber and an inertia based on the weight of the shoe 92*b* itself act on the rear side shoe 92*b*. The resultant force of the differential pressure and the inertia becomes the load. The differential pressure does not changes due to the specific gravity of the shoe 92*b*, but the inertia changes due to the specific gravity of the shoe 92*b*, so the load by which the rear side shoe 92*b* is press-contacted against the swash plate 91 changes depending on the specific gravity of the shoe 92*b*. This load changes according to the rotational angle. As shown in FIG. 6, when the load becomes 0 or minus (in the rear direction) at the start of the angular range $\alpha$ between the top dead center T and bottom dead center U, the rear side shoe 92*b* separates from the swash plate 91. When the load becomes a plus one (in the forward direction) at the end of the angular range $\alpha$, the rear side shoe 92*b* strikes the swash plate 91. Here, the energy E when the shoe 92*b* strikes the swash plate 91 is expressed as follows when the mass of the shoe 92*b* is "m" and the speed of the shoe 92*b* is "v":

$$E=(1/2)mv^2$$

Therefore, a difference arises in the energy E depending on the mass of the shoe 92*b*.

Therefore, if the shoe 92*b* is mainly comprised of a ferrous metal having a large specific gravity such as SUJ2 of Japanese Industrial Standard (the JIS), the mass of the shoe 92*b* is large and wear is caused with the surface of the swash plate 91. In particular, when using a swash plate 91 comprised of a swash plate substrate formed with a coating for improving the slidability, the coating becomes easily worn.

SUMMARY OF THE INVENTION

An object of the present invention is to provide a single-headed piston type swash plate compressor which can prevent wear of the swash plate, in particular wear of the coating on the swash plate substrate, and in turn exhibit a superior durability.

According to the present invention, there is provided a single-headed piston type swash plate compressor provided with a housing internally defining and forming cylinder bores, a crank chamber, a compression chamber, a suction chamber, and a discharge chamber; a single-headed piston accommodated in each of the cylinder bores to be able to reciprocate therein and to define the compression chamber therein; a drive shaft driven by an external drive source and supported by the housing; a swash plate synchronously rotatably supported with respect to the drive shaft; and a pair of shoes provided at the front and rear of the swash plate so as to be accommodated in the piston and to drive the piston; wherein the swash plate is comprised of a swash plate substrate made of a first metal; and at least one shoe provided at a compression chamber side are mainly comprised of a second metal or resin with a smaller specific gravity than the first metal.

Preferably, each shoe is mainly comprised of the second metal or resin.

According to a second aspect of the present invention, there is provided a single-headed piston type swash plate compressor provided with a housing internally defining and forming cylinder bores, a crank chamber, a compression chamber, a suction chamber, and a discharge chamber; a single-headed piston accommodated in each of the cylinder bores to be able to reciprocate therein and to define the compression chamber therein; a drive shaft driven by an external drive source and supported by the housing; a swash plate synchronously rotatably supported with respect to the drive shaft; and a pair of shoes provided at the front and rear of the swash plate so as to be accommodated in the piston and to drive the piston; wherein the swash plate is comprised of a swash plate substrate made of a first metal and a coating formed on at least one compression chamber side of the swash plate for improving the slidability with the first metal and at least one shoes provided at the compression chamber side of the swash plate are mainly comprised of a second metal or resin with a smaller specific gravity than the first metal.

Preferably, the at least one shoe is comprised of a shoe substrate comprised of the second metal or resin and a coating formed on the surface of the shoe substrate for improving the slidability.

Preferably, the at least one shoe is impregnated by a lubricating oil.

Preferably, the at least one piston is mainly comprised of a third metal or resin having a specific gravity smaller than the first metal.

Alternatively, the at least one piston is comprised of a piston substrate comprised of the third metal or resin having a specific gravity smaller than the first metal and a coating formed on the surface of the piston substrate for improving the slidability.

Preferably, the inclination angle of the swash plate is variable with respect to the drive shaft and the pressure in the crank chamber can be adjusted by a control valve to change the inclination angle and adjust the amount of discharge.

BRIEF DESCRIPTION OF THE DRAWINGS

These and other objects and features of the present invention will be more apparent from the following description given with reference to the accompanying drawings, wherein.

DESCRIPTION OF THE PREFERRED EMBODIMENTS

Figure 1:
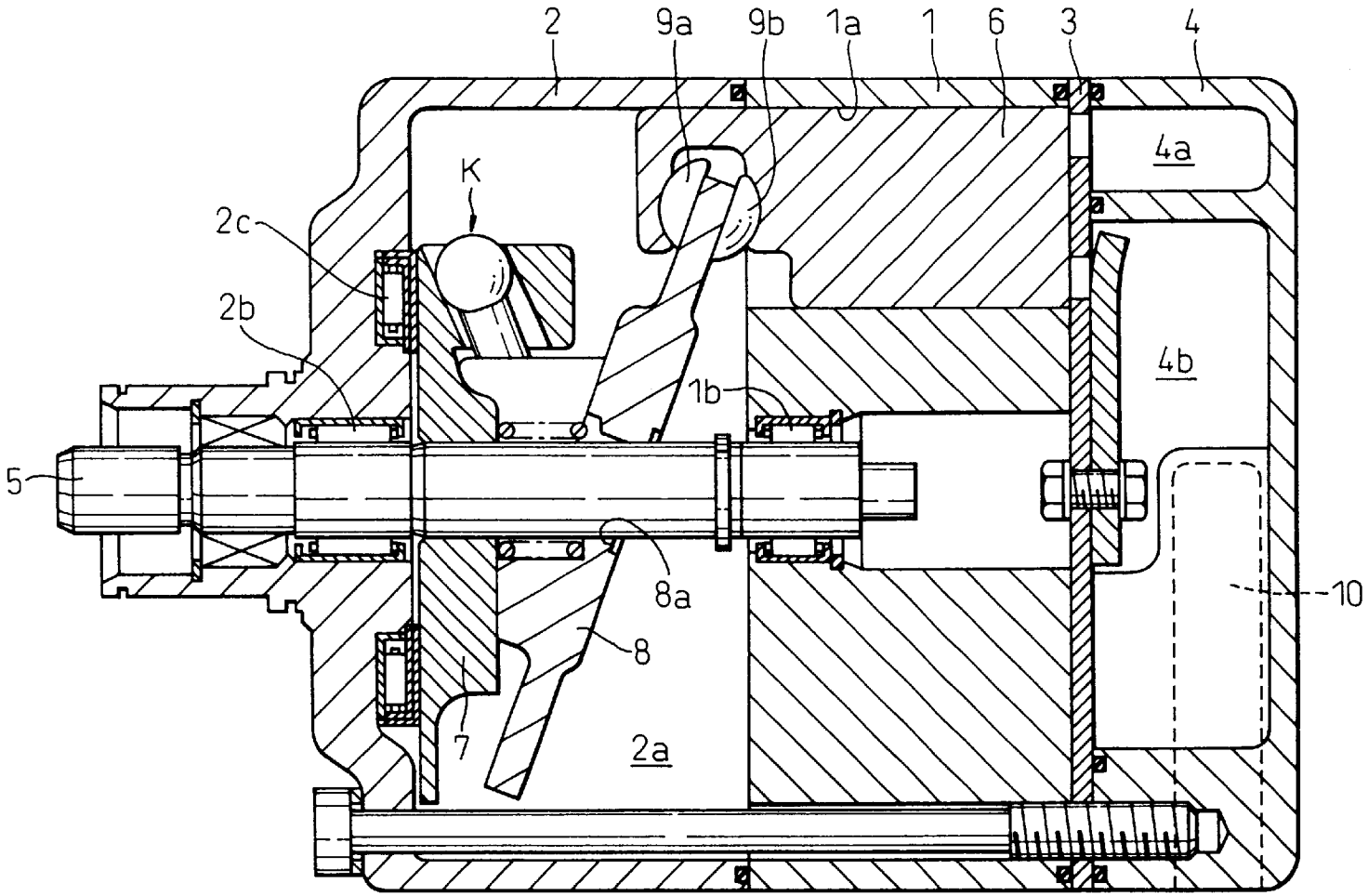
FIG. 1 is a sectional view of a variable discharge single-headed piston type swash plate compressor according to an embodiment of the present invention.

According to the first aspect of the invention, the single-headed piston type swash plate compressor according to the present invention is provided with a housing internally defining and forming cylinder bores, a crank chamber, a compression chamber, a suction chamber, and a discharge chamber; a piston accommodated in each cylinder bores to be able to reciprocate therein; a drive shaft driven by an external drive source and rotatably supported by the housing; a swash plate synchronously rotatably supported with respect to the drive shaft; and a pair of shoes provided at the front and rear of the swash plate and driving the pistons, wherein the swash plate is comprised of a swash plate substrate made of a first metal, while at least one shoe provided at a compression chamber side of the swash plate are mainly comprised of a second metal or resin with a smaller specific gravity than the first metal.

In this single-headed piston type swash plate compressor, even if the swash plate is comprised of a swash plate substrate made of a first metal such as a ferrous metal, since the rear side shoes are mainly comprised of a second metal or resin with a specific gravity smaller than the first metal, the energy when striking the swash plate is small and the swash plate becomes resistant to wear. Therefore, in this single-headed piston type swash plate compressor, a superior durability can be exhibited.

According to a second aspect of the present invention, there is provided a single-headed piston type swash plate compressor provided with a housing internally defining and forming cylinder bores, a crank chamber, a suction chamber, and a discharge chamber; single-headed pistons accommodated in the cylinder bores to be able to reciprocate therein;

a drive shaft driven by an external drive source and supported by the housing; a swash plate synchronously rotatably supported with respect to the drive shaft; and a pair of shoes at the front and rear of the swash plate for driving the pistons; wherein the swash plate is comprised of a swash plate substrate made of a first metal and a coating formed on at a compression chamber side of the swash plate for improving the slidability with the first metal and at least the shoes provided at the compression chamber side of the swash plate are mainly comprised of a second metal or resin with a smaller specific gravity than the first metal.

In this single-headed piston type swash plate compressor, even if the swash plate is comprised of a swash plate substrate made of a first metal of a ferrous metal etc. and a coating of nickel-boron plating etc., since the rear side shoes are mainly comprised of a second metal or resin having a specific gravity smaller than the first metal, the energy when striking the swash plate is small and the coating on the swash plate substrate becomes resistant to wear. Therefore, in this single-headed piston type swash plate compressor, a superior durability can be exhibited.

The swash plate substrate is comprised of a first metal. As the first metal, it is possible to use a metal having a large specific gravity and a superior strength such as a ferrous material (meaning iron or an iron alloy containing mostly iron, same below), a copper-based material (meaning copper or a copper alloy containing mostly copper, same below), a nickel-based material (meaning nickel or a nickel alloy containing mostly nickel, same below), or a molybdenum-based material (meaning molybdenum or a molybdenum alloy containing mostly molybdenum, same below).

The coating is formed on at the compression chamber side of the swash plate substrate. The swash plate substrate to be coated is preferably quench-hardened. As the coating, it is possible to use the following (1) to (8), that is, (1) a sprayed layer of a metal able to improve the slidability such as a copper-based material or aluminum-based material (meaning aluminum or an aluminum alloy mostly containing aluminum, same below), (2) a sintered layer of a metal able to improve the slidability such as a copper-based material or aluminum-based material, (3) a coating layer comprised of polyamide imide (PAI), polyimide (PI), polyetheretherketone (PEEK), or other resin having a heat resistance of at least 130° C. in which is dispersed a solid lubricant such as molybdenum disulfide ($MoS_2$), graphite, tungsten disulfide ($WS_2$), boronitride (BN), and polytetrafluoroethylene (PTFE), (4) a plating layer of a metal able to improve the slidability such as tin plating, nickel-phosphorus plating, nickel-boron plating, nickel-phosphorus-boron plating, nickel-phosphorus-boron-tungsten (Ni—P—B—W) plating, nickel-phosphorus-boron-tungsten-chrome plating, and hard chrome plating, (5) an ion plating layer obtained by chemical vapor deposition (CVD) or physical vapor deposition (PVD) of a material able to improve the slidability such as titanium nitride (TiN), chrome nitride (CrN), and titanium-aluminum-nitride (TiAlN); (6) a layer comprised of diamond-like carbon (DLC) etc., (7) a ceramic coat, and (8) alumite. Further, when not forming a coating on the front surface of the swash plate substrate, it is preferable to quench-harden the front surface.

The second metal by which the rear side shoes can be mainly formed has a specific gravity smaller than the first metal. As the second metal means an aluminum-based material, titanium-based material (meaning titanium or a titanium alloy mainly comprised of titanium, same below), a magnesium-based material (meaning magnesium or a magnesium alloy mainly comprised of magnesium, same below), etc. When comprising the rear side shoes mainly by an aluminum-based material, as the aluminum-based material, it is possible to use the JIS 4032 aluminum material (Si of 10 to 13%) A2014 or A2017 or the JIS AD212 or other die cast materials.

Further, the resin by which the rear side shoes can be mainly formed also has a specific gravity smaller than the first metal. As the resin, it is possible to use polyamide imide (PAI), polyetheretherketone (PEEK), a phenol resin (PF), an epoxy resin (EP), polyphenylene sulfide (PPS), or another resin having a heat resistance of at least 130° C. When making the rear side shoes mainly by a resin, to improve the abrasion resistance or to reduce the heat expansion coefficient, it is possible to disperse a carbon fiber or glass fiber etc.

When using a swash plate comprised of only a swash plate substrate, it is preferable to use shoes mainly comprised of the second metal or resin. That is, it is preferable to use front side shoes the same as the rear side shoes. By doing this, it is possible to realize a reduction in the manufacturing costs of the shoes. Further, this enables a good balance between the front side shoes and rear side shoes.

Further, when using a swash plate formed with a coating on the swash plate substrate so as to improve the slide, it is preferable to use a swash plate comprised of a swash plate substrate and coatings formed on the front and rear surfaces of the swash plate substrate and to use shoes mainly comprised of the second metal or a resin. That is, it is preferable to use a swash plate having on its front surface a coating the same as the rear surface of the swash plate substrate and to use front side shoes the same as the rear side shoes. By doing this, it is possible to realize a reduction in the manufacturing costs of the swash plate and the shoes. Further, whether the single-headed piston type swash plate compressor is a fixed-displacement type or a variable-displacement type, it is possible to prevent wear of the coating formed on the front surface of the swash plate substrate and exhibit superior durability under severe conditions.

Figure 7:
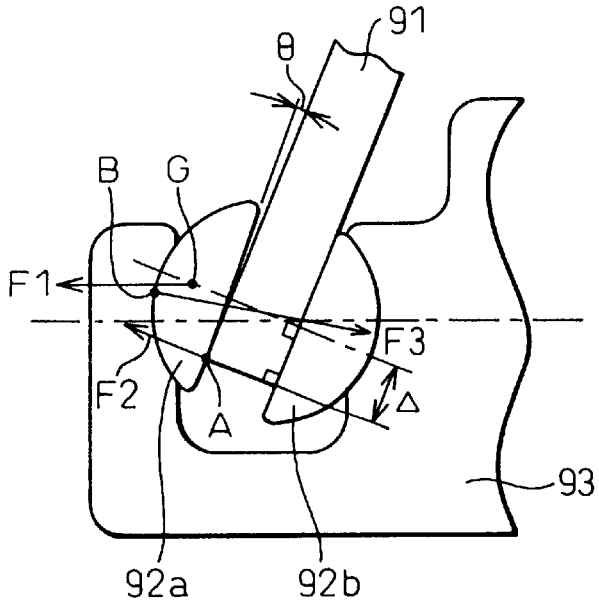
FIG. 7 is an enlarged sectional view of the principal parts of a swash plate, shoes, and a piston according to a general variable displacement single-headed piston type swash plate compressor.

That is, in the single-headed piston type swash plate compressor, it is possible to use a swash plate formed with a coating on the swash plate substrate without regard to the front or rear surface. Further, as shown in FIG. 7, when the swash plate 91 is positioned at the bottom dead center, an inertia F1 due to the weight of a shoe 92*a*, which is located at the front side (left side in FIG. 3) of the swash plate at the bottom dead center position acts on the center of gravity G in the axial direction. Therefore, the shoe 92*a* receives a reaction force F3 corresponding to the resultant force of the inertial force F1 from the center of gravity G and a normal reaction force F2, which acts perpendicularly to a front side edge A and shifts by the direction A from the regular position towards the outside of the swash plate. Thus, the shoe 92*a* receives the force F3 at the position B that connects to the shoe seats placed in the front side of the piston. The inertia F1 differs according to the specific gravity of the shoe 92*a* and the rotational speed of the drive shaft, so the normal force F2 also differs depending on the specific gravity of the shoe 92*a* and the rotational speed of the drive shaft. Therefore, if the shoe 92*a* is mainly comprised of a ferrous metal such as SUJ2 according to JIS having a large specific gravity, the mass of the shoe 92*a* becomes large and the coating on the swash plate substrate, especially at the front edge A, is easily worn. As opposed to this, when making the shoes 92*a* by mainly the second metal or resin with the smaller specific gravity, the mass of the shoes 92*a* is small and the coating on the swash plate substrate will not be easily worn. Therefore, in a single-headed piston type swash plate compressor, a much greater durability can be exhibited.

It is possible to make each shoe by a shoe substrate made of the second metal or resin and a coating formed on the surface of the shoe substrate for improving the slidability. As the coating, it is possible to use one of the above (1) to (8) different from the coating formed on the swash plate substrate. This coating may be the same or different between the flat part sliding with the swash plate and the spherical part sliding with a shoe seat of the piston. Further, when not forming a coating on the flat part or spherical part of the shoe substrate, the flat part or spherical part is preferably quench-hardened etc.

When making the shoes by mainly the second metal or resin, it is possible to form the shoes by the second metal or resin in a manner giving continuous pores and impregnate the pores with a lubricating oil. By doing this, it is possible to ensure the slidability of the sliding portion between the swash plate and shoes and between the shoes and the shoe seats of the pistons.

The pistons are preferably mainly comprised of a third metal or resin having a specific gravity smaller than the first metal. As the third metal, it is possible to use an aluminum-based material, titanium-based material, magnesium-based material, etc. When making the pistons mainly by an aluminum-based material, as the aluminum-based material, it is possible to use the JIS 4032 aluminum materials (Si of 10 to 13%) A2014 or A2017 or the JIS ADS12 or other die cast materials.

Further, the resin by which the pistons may be mainly comprised also has a specific gravity smaller than that of the first metal. As the resin, it is possible to use polyamide imide (PAI), polyetheretherketone (PEEK), a phenol resin (PF), an epoxy resin (EP), polyphenylene sulfide (PPS), or another resin having a heat resistance of at least 130° C. When making the pistons mainly by a resin, to improve the abrasion resistance or to reduce the heat expansion coefficient, it is possible to disperse a carbon fiber or glass fiber etc.

The pistons can be made of a piston substrate comprised of a third metal or resin and a coating formed on the surface of the piston substrate to improve the slide. As this coating, it is possible to use one of the above (1) to (8) different from the coating formed on the shoe substrate. When not forming a coating on the piston substrate, it is preferable to quench-harden the substrate.

The single-headed piston type swash plate compressor of the present invention is particularly effective in the case of a variable displacement type where the inclination angle of the swash plate is provided to be variable with respect to the drive shaft and the pressure inside the crank chamber is adjusted by a control valve so as to change the inclination angle and adjust the discharge capacity. In this variable-displacement single-headed piston type swash plate compressor, since the swash plate substrate of the swash plate is made larger in specific gravity than that of the shoes or pistons, the centrifugal force of the swash plate acting in the direction reducing the inclination angle becomes larger. Therefore, in this variable capacity type single-headed piston type swash plate compressor, it is possible to prevent a decline in the high speed controllability due to the inertia of the shoes or pistons acting in a direction increasing the inclination angle.

Next, a specific embodiment of the present invention will be explained with reference to the drawings.

In the variable displacement single-headed piston type swash plate compressor of the present embodiment (hereinafter referred to simply as a "compressor"), as shown in FIG. 1, a front housing 2 is connected to the front end of the cylinder block 1. A crank chamber 2*a* is formed in the cylinder block 1 and the front housing 2. A rear housing 4 is connected to the rear end of the cylinder block 1 through a valve mechanism 3 comprised of suction valve, valve plates, discharge valves, and retainers. A suction chamber 4*a* and discharge chamber 4*b* are formed in the rear housing 4. The suction chamber 4*a* is connected to a not shown evaporator, the evaporator is connected through a not shown expansion valve to a not shown condenser, and the condenser is connected to the discharge chamber 4*b*.

The drive shaft 5 is rotatably supported at the front housing 2 and the cylinder block 1 through bearings 2*b*, 1*b*. A plurality of cylinder bores 1*a* parallel with the axis of the drive shaft 5 are formed in the cylinder block 1. A single-headed piston 6 is accommodated in each cylinder bore 1*a* to be able to reciprocate therein.

A rotor 7 is fixed to the drive shaft 5 and the drive shaft able to rotate in the crank chamber 2*a* through a bearing 2*c* adjacent to the front housing 2. The swash plate 8 is oscillatingly provided on the rotor 7 through a pair of hinge mechanisms K. A through hole 8*a* is formed in the swash plate 8. The drive shaft 5 is inserted through the through hole 8*a* while allowing oscillating movement of the swash plate 8. Pairs of shoes 9*a*, 9*b* are provided at the front and rear of the swash plate 8. The pistons 6 are engaged with the swash plate 8 through a pair of shoes 9*a*, 9*b*. The shoes 9*a*, 9*b* sandwich the swash plate 8, and the flat surface of the shoes 9*a*, 9*b* contact the front and rear surfaces of the swash plate 8. The spherical surfaces of the shoes 9*a*, 9*b* contact a pair of the spherical shoe seats in engagement portion in the piston 6 to be accommodated therein.

Further, the rear housing 4 accommodates a control valve 10 connected to the suction chamber 4*a*, the discharge chamber 4*b*, and the crack chamber 2. The control valve 10 adjusts the pressure in the crack chamber 2*a* to change the inclination angle of the swash plate 8 and adjust the discharge capacity.

In the compressor of the above embodiment, as shown in Table 1 and Table 2, the configurations of the swash plate 8, the shoes 9*a*, 9*b*, and the pistons 6 were changed as Test Examples 1 to 16.

TABLE 1

| | Swash plate | | | Shoes | | | Pistons | |
|---|---|---|---|---|---|---|---|---|
| Test Ex. | Front surface | Swash plate substrate | Rear surface | Flat part | Shoe substrate | Spherical part | Shoe seat | Piston substrate |
| 1 | Cu flame-coated layer | Fe-based material | Cu flame-coated layer | Ni—P—B—W plating | Al-based material | Ni—P—B—W plating | Sn plating | Al-based material |
| 2 | Cu sintering | Fe-based material | Cu sintering | Ni—P—B—W plating | Al-based material | Ni—P—B—W plating | Sn plating | Al-based material |

TABLE 1-continued

| | Swash plate | | | Shoes | | | Pistons | |
|---|---|---|---|---|---|---|---|---|
| Test Ex. | Front surface | Swash plate substrate | Rear surface | Flat part | Shoe substrate | Spherical part | Shoe seat | Piston substrate |
| 3 | Cu flame-coated layer + resin coat | Fe-based material | Cu flame-coated layer + resin coat | Ni—P—B—W plating | Al-based material | Ni—P—B—W plating | Sn plating | Al-based material |
| 4 | Al flame-coated layer + resin coat | Fe-based material | Al flame-coated layer + resin coat | Ni—P—B—W plating | Al-based material | Ni—P—B—W plating | Sn plating | Al-based material |
| 5 | Resin coat | Fe-based material | Al flame-coated layer + resin coat | Ni—P—B—W plating | Al-based material | Ni—P—B—W plating | Sn plating | Al-based material |
| 6 | Resin coat | Fe-based material | Al flame-coated layer + resin coat | DLC | Al-based material | DLC | Sn plating | Al-based material |
| 7 | Resin coat | Fe-based material | Resin coat | Ni—P—B—W plating | Al-based material | Ni—P—B—W plating | Sn plating | Al-based material |
| 8 | Sn plating | Fe-based material | Sn plating | TiN layer | Al-based material | TiN layer | Sn plating | Al-based material |
| 9 | Resin coat | Fe-based material | Resin coat | — | Al-based material | — | Ni—P—B—W plating | Al-based material |
| 10 | Resin coat | Cu-based material | Resin coat | Ni—P—B—W plating | Al-based material | Ni—P—B—W plating | Sn plating | Al-based material |
| 11 | — | Fe-based material | Resin coat | Sn plating | Al-based material | Ni—P plating | Sn plating | Al-based material |
| 12 | — | Fe-based material | Resin coat | — | Oil-bearing foamed resin | — | Sn plating | Al-based material |

TABLE 2

| | Swash plate | | | Shoes | | | Pistons | |
|---|---|---|---|---|---|---|---|---|
| Test Ex. | Front surface | Swash plate substrate | Rear surface | Flat part | Shoe substrate | Spherical part | Shoe seat | Piston substrate |
| 13 | — | Fe-based material | — | — | Al-based material | — | Ni—P—B—W-plating | Al-based material |
| 14 | — | Fe-based material | — | Resin coat | Al-based material | — | Ni—P—B—W-plating | Al-based material |
| 15 | — | Cu-based material | — | — | Al-based material | — | Ni—P—B—W-plating | Al-based material |
| 16 | — | Cu-based material | — | Ni—P—B—W-plating | Al-based material | Ni—P—B—W-plating | Sn-plating | Al-based material |

Figure 2:
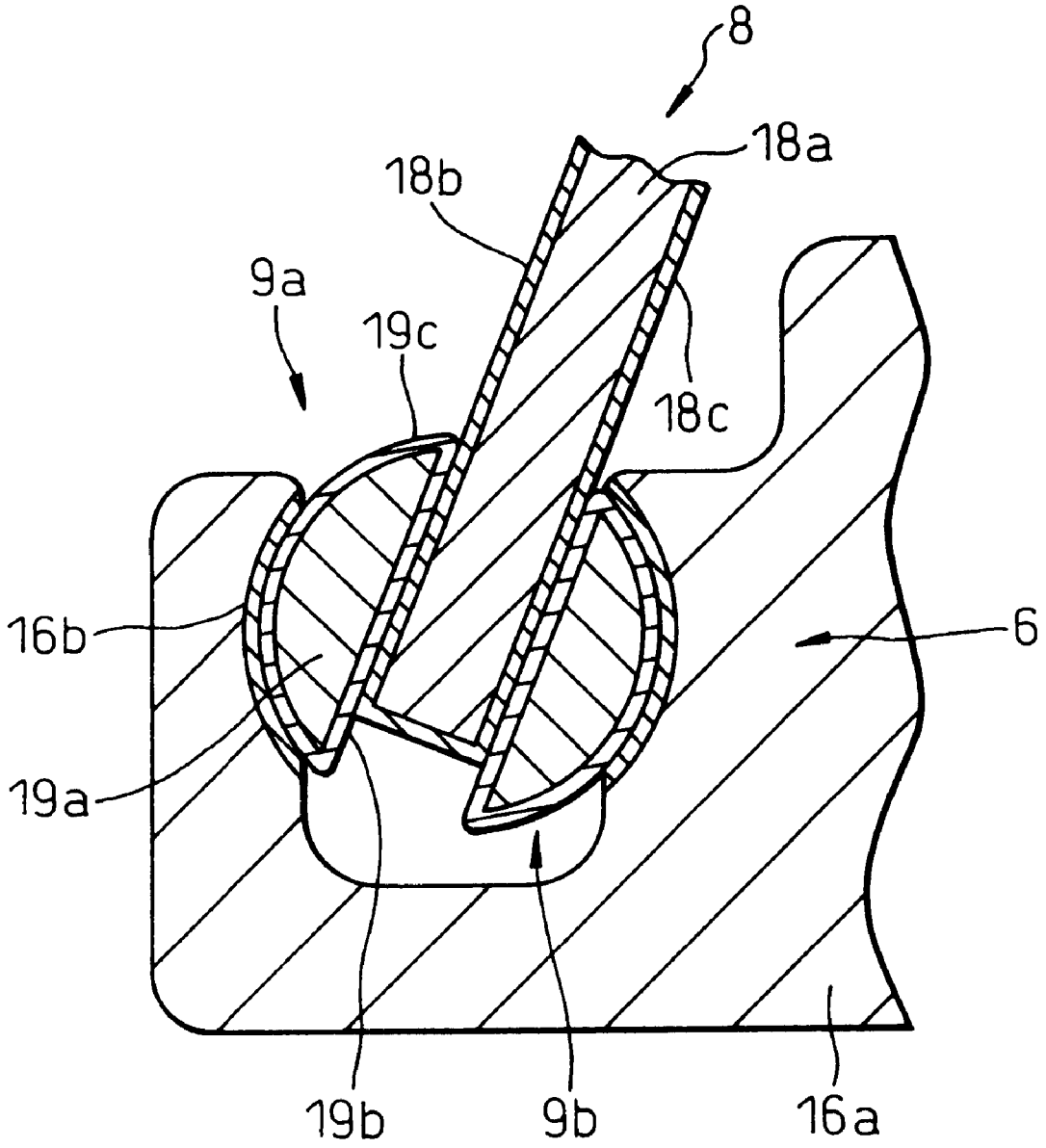
FIG. 2 is an enlarged sectional view of the principal parts of a variable displacement single-headed piston type swash plate compressor of Test Examples 1 to 12.

Here, "Cu flame-coated layer" means a sprayed layer using lead bronze as the copper-based material. "Cu sintering" means a sintered layer using lead bronze as the copper-based material as well. "Resin coat" means a coating layer obtained by dispersing $MoS_2$ and graphite in PAI. The structure regarding the front and rear surfaces in Table 1 shows a further formation of the latter coating on the former coating. "Al flame-coated layer" means a flame-sprayed layer using Al—Si alloy as the aluminum-based material. As shown in FIG. 2, the ferrous material of the swash plate substrate 18*a* is FCD700, while the copper-based material is lead bronze. Further, the "TiN layer" means an ion plating layer obtained by physical vapor deposition (PVD). The aluminum-based material of the shoe substrate 19*a* is an A4032-based alloy. The "oil-bearing foamed resin" is obtained by causing a for example phenol resin to foam to obtain continuous pores, then impregnating the pores with a lubricating oil. Further, the aluminum-based material of the piston substrate 16*a* is for example A4032 or ADC12.

In the compressors of Test Examples 1 to 12, the swash plate 8 is comprised of a swash plate substrate 18*a* made of a ferrous material or a copper-based material, a coating 18*b* comprised of a copper flame-coated layer, a copper flame-coated layer+resin coat, an aluminum flame-coated layer+resin coat, a resin coat, or tin plating formed on the front surface of the swash plate substrate 18*a*, and a coating 18*c* comprised of a copper flame-coated layer, copper flame-coated layer +resin coat, aluminum flame-coated layer +resin coat, resin coat, or tin plating formed on the rear surface of the swash plate material 18*a*.

The front side and rear side shoes 9*a* and 9*b* are each comprised of a shoe substrate 19*a* made of an aluminum-based material, a coating 19*b* comprised of an Ni—P—B—W plating, DLC, or TiN layer formed on the flat part of the shoe substrate 19*a*, and coating 19*c* comprised of an Ni—P—B—W plating, DLC, or TiN layer formed on the spherical part of the shoe substrate 19*a*. Further, the front side and rear side shoes 9*a*, 9*b* are comprised of foamed resin impregnated with a lubricating oil.

Further, each piston 6 is comprised of a piston substrate 16*a* made of an aluminum-based material and a coating 16*b* made of tin plating formed on the shoe seat of the piston substrate 16*a*.

Therefore, in the compressors of Test Examples 1 to 12, the energy when the shoes 9*a*, 9*b* strike the swash plate 8 is small and the mass of the shoes 9*a*, 9*b* is small, so the coatings 18*b*, 18*c* on the swash plate substrate 18*a* become resistant to wear. Therefore, in these compressors, an even more superior durability can be exhibited.

In the compressors of Test Examples 1 to 12, since the swash plate substrate 18*a* of the swash plate 8 is larger in specific gravity than that of the shoes 9*a*, 9*b* or pistons 6, the centrifugal force of the swash plate 8 acting in the direction reducing the inclination angle becomes larger. Therefore, in these compressors, it is possible to prevent a decline in the high speed controllability due to the inertia of the shoes 9*a*, 9*b* or pistons 6 acting in a direction increasing the inclination angle.

In a compressor where lubricating oil is impregnated in the shoes 9*a*, 9*b*, it is easy to secure the slidability of the sliding portions between the swash plate 8 and shoes 9*a*, 9*b* and between the shoes 9*a*, 9*b* and the pistons 6.

Note that in the compressors of Test Examples 13 to 16, since the swash plate 8 do not have the coatings 18*b*, 18*c*, it is possible to prevent wear of the swash plate substrate 18*a* itself and other actions and effects can be exhibited. Further, in these compressors, since there is no need to form the coatings 18*a*, 18*b* on the swash plate 8, there is an advantage in terms of the manufacturing cost and an advantage in terms of work efficiency as well.

The Test Examples 1 to 16 shown in Table 1 and Table 2 are only examples. Naturally other combinations are also possible.

First Evaluation

Figure 3A:
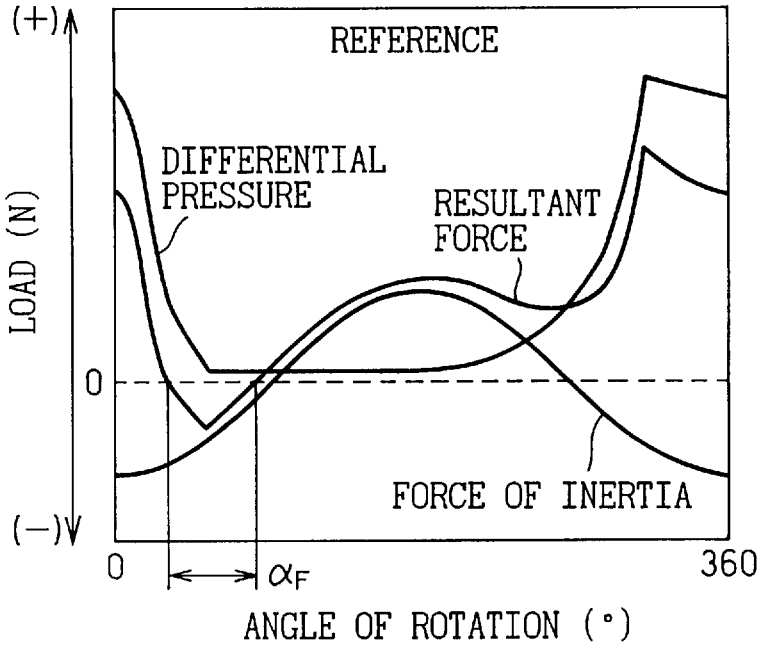
FIG. 3A is a graph of the relationship between a rotational speeds and load of a variable capacity type single-headed piston type swash plate compressor of a comparative example according to a first evaluation.
Figure 3B:
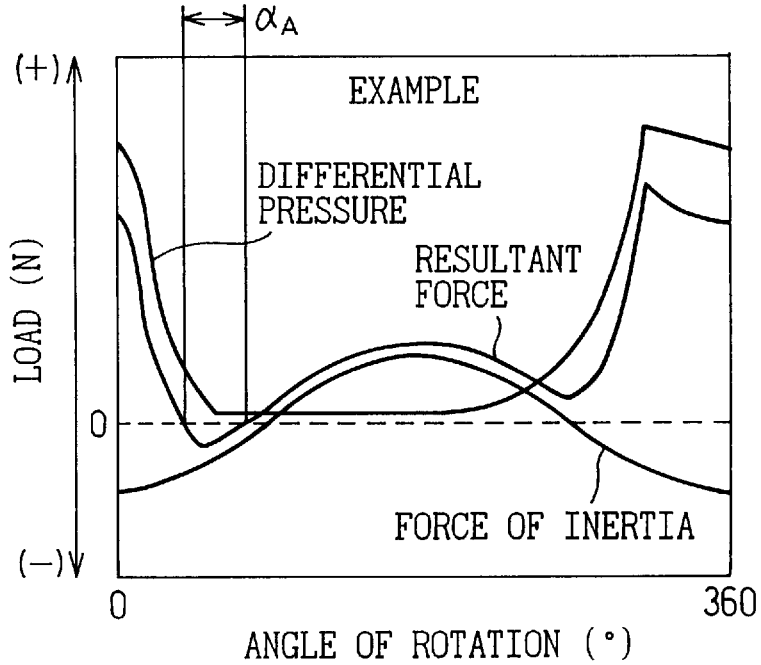
FIG. 3B is a graph of the relationship between a rotational speeds and load of a variable capacity type single-headed piston type swash plate compressor of an example of the invention according to a first evaluation.

According to actual tests of the inventors, the relationship between the rotational angle (degrees) and load (N) of a compressor of a comparative example (where the shoes 9*a*, 9*b* are made of SUJ2) becomes as shown in FIG. 3A. Further, the relationship between the rotational angle (degrees) and load (N) of a compressor of an example of the invention where the shoes 9*a*, 9*b* are comprised of a shoe substrate 19*a* of a JISA4032-based aluminum material and coatings 19*b*, 19*c* made of Ni—P plating on the shoe substrate 19*a* becomes as shown in FIG. 3B. Note that the rest of the conditions are the same between the compressor of the comparative example and the compressor of the example of the invention.

In FIG. 3A and FIG. 3B, since the specific gravity of SUJ2 is about 7.8 and the specific gravity of AHS is about 2.7, in the compressor of the example of the invention, the inertia acting on the rear side shoe 9*b* becomes an inverse multiple compared with the compressor of the comparative example (7.8/2.7), that is, about 1/2.9. Therefore, it is learned that in the compressor of the comparative example, the swash plate 8 acts by a larger load than the compressor of the example of the invention and the coating 18*c* on the swash plate substrate 18*a* becomes easily worn.

Note that it is learned that the angular range $a_A$ where the load becomes 0 or minus in the compressor of the example of the invention is narrower than the angular range $a_F$ where the load becomes 0 or minus in the compressor of the comparative example. Therefore, the time during which the rear side shoe 9*b* is separated from the swash plate 8 in the compressor of the example of the invention is shorter than in the compressor of the comparative example.

Second Evaluation

Figure 4:
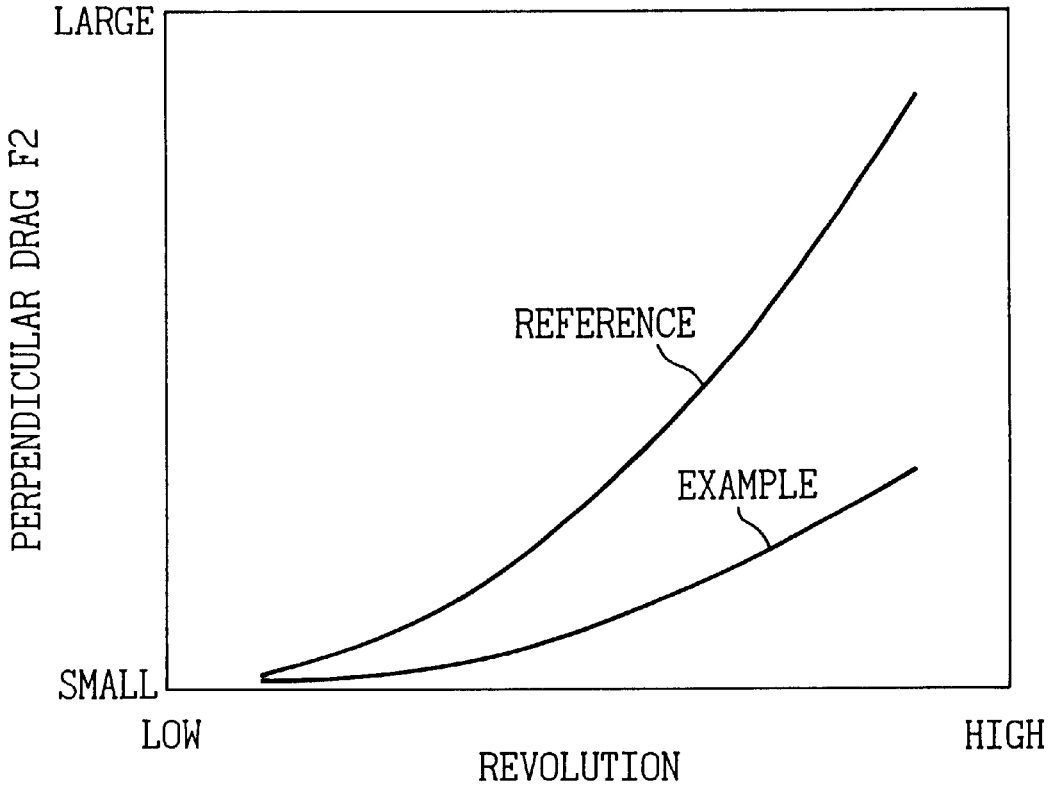
FIG. 4 is a graph of the relationship between a rotational speeds and normal force of variable capacity type single-headed piston type swash plate compressors of an example of the invention and a comparative example according to a second evaluation.

Further, according to the results of tests of the inventors, the relations between the rotational angle and normal force F2 in a compressor of the comparative example and a compressor of an example of the invention become as shown in FIG. 4.

In FIG. 4, since the specific gravity of SUJ2 is about 7.8 and the specific gravity of AHS is about 2.7, in the compressor of the example of the invention, the normal force F2 acting on the front side shoe 9*a* becomes an inverse multiple compared with the compressor of the comparative example (7.8/2.7), that is, about 1/2.9. Therefore, it is learned that in the compressor of the example of the invention, compared with the compressor of the comparative example, regardless of the rotational speed, the normal force F2 is smaller and the coating 18*b* on the swash plate substrate 18*b* is resistant to wear.

Third Evaluation

Figure 5:
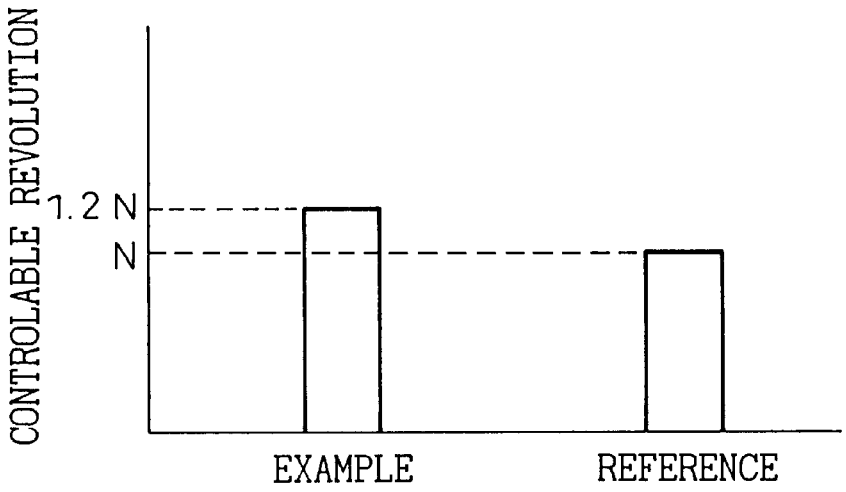
FIG. 5 is a graph comparing the controllable rotational speeds of variable capacity type single-headed piston type swash plate compressors of an example of the invention and a comparative example according to a third evaluation.
Figure 6:
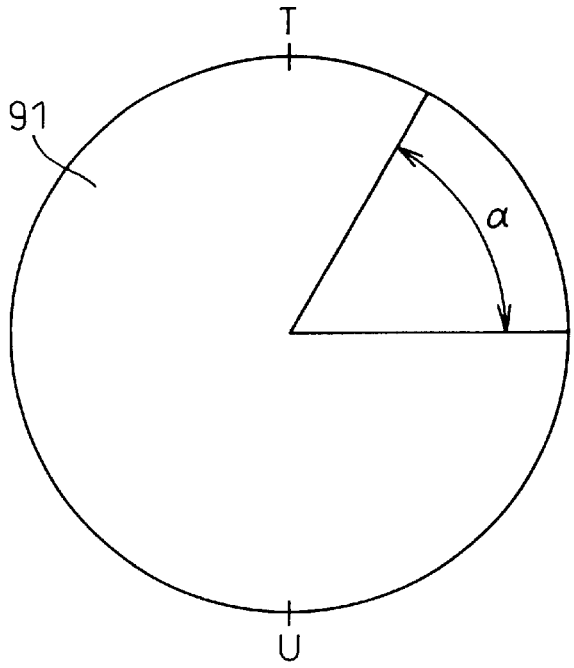
FIG. 6 is a schematic plan view of a swash plate seen from the rear in the axial direction according to a general variable displacement single-headed piston type swash plate compressor.

Further, according to the results of tests by the inventors, the controllable rotational speeds of the compressor of the comparative example and the compressor of the example of the invention become as shown in FIG. 5. Here, in the compressor of the example of the invention, the rotational speed of the limit where the inclination angle of the swash plate 8 does not fluctuate (hunting) is defined as the controllable rotational speed, while the controllable rotational speed of the compressor of the comparative example is shown by a ratio with N.

From FIG. 5, it is learned that the compressor of the example of the invention exhibits a high speed controllability of 1.2 times that of the compressor of the comparative example.

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-214231, filed on Jul. 14, 2000, the disclosure of which is expressly incorporated herein by reference in its entirety.

What is claimed is:

1. A single-headed piston type swash plate compressor provided with:

a housing internally defining and forming cylinder bores, a crank chamber, a compression chamber, a suction chamber, and a discharge chamber;

a single-headed piston accommodated in each of the cylinder bores to be able to reciprocate therein and to define the compression chamber therein;

a drive shaft driven by an external drive source and supported by the housing;

a swash plate synchronously rotatably supported with respect to the drive shaft; and a pair of shoes provided at the front and rear of the swash plate so as to be accommodated in the piston and to drive the piston; wherein:

the swash plate is comprised of a swash plate substrate made of a first metal;

at least one shoe provided at a rear surface of the swash plate substrate is mainly comprised of a second metal or resin with a smaller specific gravity than the first metal; and at least one shoe is impregnated by a lubricating oil.

2. A single-headed piston type swash plate compressor provided with:

a housing internally defining and forming cylinder bores, a crank chamber, a compression chamber, a suction chamber, and a discharge chamber;

a single-headed piston accommodated in each of the cylinder bores to be able to reciprocate therein and to define the compression chamber therein;

a drive shaft driven by an external drive source and supported by the housing;

a swash plate synchronously rotatably supported with respect to the drive shaft; and a pair of shoes provided at the front and rear of the swash plate so as to be accommodated in the piston and to drive the piston; wherein the swash plate is comprised of a swash plate substrate made of a first metal and a coating formed on a rear surface of the swash plate substrate for improving the slidability with the first metal; and at least one shoe provided on the rear surface of the swash plate substrate is mainly comprised of a second metal or resin with a smaller specific gravity than the first metal.

3. A single-headed piston type swash plate compressor as set forth in claim 2, wherein the swash plate is further comprised of a second coating formed on a front surface of the swash plate substrate and wherein each of the shoes is mainly comprised of the second metal or resin.

4. A single-headed piston type swash plate compressor as set forth in claim 2, wherein at least one shoe is comprised of a shoe substrate comprised of the second metal or resin and a coating formed on the surface of the shoe substrate for improving the slidability.

5. A single-headed piston type swash plate compressor as set forth in claim 2, wherein at least one shoe is impregnated by a lubricating oil.

6. A single-headed piston type swash plate compressor as set forth in claim 2, wherein at least one piston is mainly comprised of a third metal or resin having a specific gravity smaller than the first metal.

7. A single-headed piston type swash plate compressor as set forth in claim 2, wherein at least one piston is comprised of a piston substrate comprised of the third metal or resin having a specific gravity smaller than the first metal and a coating formed on the surface of the piston substrate for improving the slidability.

8. A single-headed piston type swash plate compressor as set forth in claim 2, wherein the inclination angle of the swash plate is variable with respect to the drive shaft and the pressure in the crank chamber is adjustable by a control valve to change the inclination angle and adjust the amount of discharge capacity.

* * * * *